United States Patent [19]

Hikake et al.

[11] Patent Number: 4,784,333

[45] Date of Patent: Nov. 15, 1988

[54] PROCESS FOR PRODUCING TONER POWDER

[75] Inventors: Norio Hikake, Yokohama; Nobuyuki Asaoka, Abiko; Naoto Kitamori, Yokohama, all of Japan

[73] Assignee: Canon Kabushiki Kaisha, Tokyo, Japan

[21] Appl. No.: 110,281

[22] Filed: Oct. 20, 1987

[30] Foreign Application Priority Data

Oct. 29, 1986 [JP] Japan ..... 61-258948
Oct. 29, 1986 [JP] Japan ..... 61-258949

[51] Int. Cl.[4] ..... B02C 19/12

[52] U.S. Cl. ..... 241/5; 241/19; 241/24; 241/29; 430/137

[58] Field of Search ..... 241/24, 29, 76, 78, 241/97, 79.1, 19, 77, 80, 5, 39, 40; 430/137, 111, 121

[56] References Cited

U.S. PATENT DOCUMENTS 4,304,360 12/1981 Luhr et al. ..... 241/5

*Primary Examiner*—Mark Rosenbaum

*Attorney, Agent, or Firm*—Fitzpatrick, Cella, Harper & Scinto

[57] ABSTRACT

Colored resinous particles suitable for use in toner powder for developing electrostatic latent images are produced from a pulverized feed at a good production efficiency and with a sharp particle size distribution through a classifying and pulverizing system including a second pulverization step associated with a second classification step in addition to a first classification step, such a second classification step and first pulverization step. The pulverized feed supplies to the first classification step is classified into a first classified fine powder and a first coarse powder, which is then pulverized in the first pulverization step and recycled to the first classification step. The first classified fine powder is supplied to the second classification step and classified therein into a second classified fine powder and a second coarse powder, which is then pulverized in the second pulverization step and recycled to the first classification step or the second classification step. The second pulverization step is effected under the action of an impact force which is smaller than that exerted in the first pulverization step.

12 Claims, 9 Drawing Sheets

PROCESS FOR PRODUCING TONER POWDER

FIELD OF THE INVENTION AND RELATED ART

The present invention relates to a process for producing colored resinous particles for use in toner powder by melt-kneading a composition comprising at least a binder resin and a colorant or magnetic material, cooling and solidifying the kneaded product, and effectively pulverizing and classifying the solidified product.

Conventionally, such colored resinous particles for providing toner powder have been produced by melt-kneading a composition comprising at least a binder resin and a colorant or magnetic material, solidifying the kneaded product under cooling, coarsely pulverizing the solidified product, and treating the coarsely pulverized material in a system combining one classifier and one pulverizer or a system combining two classifiers and one pulverizer. A classifier for removing minute powder is further incorporated according to necessity in such a system. The pulverizer may for example be a jet mill wherein a high-pressure gas stream is discharged through a jet nozzle to form a jet gas stream, the particles are conveyed at a high speed by means of the jet gas stream thus formed to impinge on an impinging object such as an impinging plate thereby pulverizing the particles. As the classifier, a fixed wall-type wind-force classifier including a centrifugal air classification means. Ordinarily, colored resinous particles for a toner are produced through a system wherein a pulverizing means such as a jet mill and one or two wind-force classifiers are connected.

Production flow charts shown in FIGS. 2 and 3 each represent an example of such conventional systems. Referring to FIG. 2, feed powder is introduced through a feed supply pipe into a classifying means where it is classified into a coarse powder and a fine powder. The coarse powder is introduced into and pulverized in a pulverizing means and then again introduced into the classifying means. On the other hand, the fine powder is withdrawn out of the system and introduced to a classification step not shown in the figure where minute powder contained in the fine powder and having particle sizes below the prescribed range is further removed to provide colored resinous particles for a toner.

In this system, however, the powder supplied to the classifying means includes, in addition to the feed powder, particles of various particle sizes which are in the course of pulverization and recycling between the pulverizing means and the classifying means, so that it is liable to have a very broad particle size distribution and the system is operated under a very large load. As a result, the classification efficiency of the classifier is lowered, the energy consumed in the pulverizing means is not effectively utilized, and it is highly possible that coarse particles exerting ill effects to toner qualities are commingled into the classified fine powder (pulverized product).

On the other hand, the coarse powder recycled to the pulverizing step contains some proportion of fine powder which does not require further pulverization but is actually further pulverized, so that the pulverized product is liable to contain a large proportion of minute powder and agglomerates of the minute powder can occur in the pulverized product. Thus, even if the minute powder is removed in the subsequent classification step to obtain a desired particle size, the yield of the pulverized product is liable to be low. As described hereinbefore, the colored resinous particles are liable to contain large proportions of coarse particles and minute particles, so that a developer formulated by using the colored resinous particles is liable to provide toner images with a low image density and much fog.

As an improvement in the above described system, it has been tried to increase the classification accuracy of the classifier attached to the pulverizer by providing a second classifying means as shown in FIG. 3, by setting a relatively coarse classifying point in the first classifying means for classifying the feed into a relatively coarse coarse powder and a relatively coarse fine powder and further separating a coarse powder fraction from the fine powder. This provides some improvement with respect to the above problem but on the other hand complicates the process and increases the investment cost to nearly two times because a conveying means is required between the first and second classifying means. Further, there also arises a problem that the production efficiency is not increased in proportion with the increase in running cost due to an increase in energy for operating the first classifying means and the conveying means.

SUMMARY OF THE INVENTION

The present invention aims at solving the above described problems involved in the conventional processes for producing colored resinous particles for providing a toner.

A principal object of the present invention is to provide a process for effectively producing colored resinous particles for use as a toner for developing electrostatic images having a uniform and accurate particle size distribution at a low energy consumption.

More specifically, according to the present invention, there is provided a process for producing colored resinous particles for use in toner powder, comprising:

- preparing a pulverized feed material by melt-kneading a composition comprising at least a binder resin and a colorant or magnetic material, cooling and solidifying the kneaded product, and pulverizing the solidified product;
- introducing the pulverized feed material into a first classification step to classify the feed material into a first coarse powder and a first classified fine powder;
- introducing the classified first coarse powder into a first pulverization step to pulverize the coarse powder under the action of an impact force;
- introducing the resultant pulverized product of the first coarse powder into the first classification step together with the pulverized feed material;
- introducing the first classified fine powder into a second classification step to classify the fine powder into a second coarse powder and a second classified fine powder;
- introducing the classified second coarse powder into a second pulverization step to pulverize the coarse powder under the action of an impact force which is smaller than that exerted in the first pulverization step;
- introducing the resultant pulverized product of the second coarse powder into the first classification step or the second classification step; and
- removing a minute powder fraction from the second classified fine powder for adjusting a particle size distribution, thereby to obtain the colored resinous particles.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
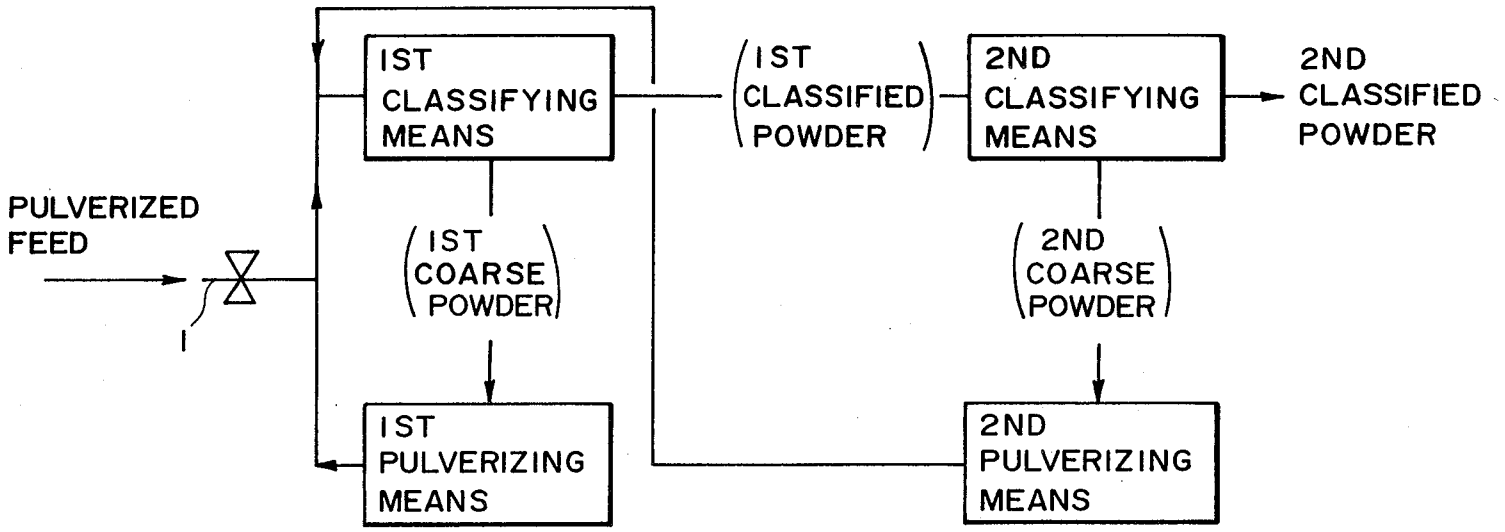
FIG. 1 is a block diagram of the process according to the present invention.
Figure 2:
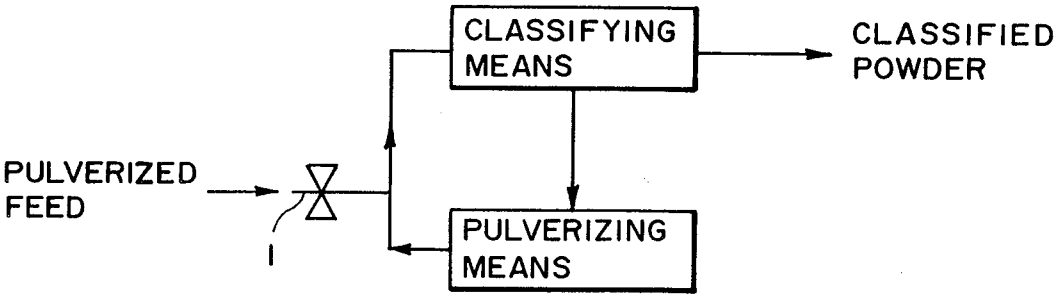
FIG. 2 PRIOR ART
FIGS. 2 and 3 are respectively a block diagram representing a conventional process.
Figure 9:
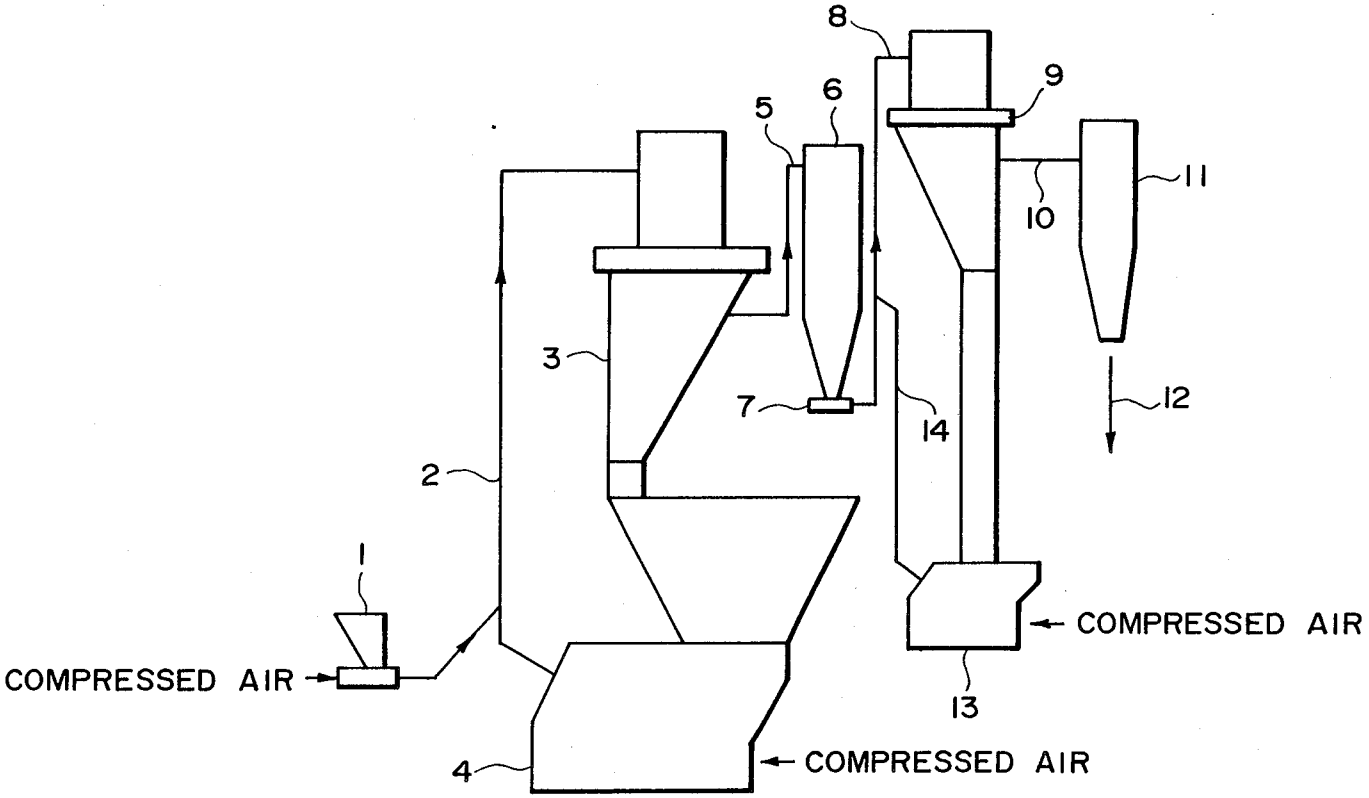
FIG. 9 is a flow chart according to another embodiment of the invention.

FIGS. 1 and 9 are block flow charts showing an outline of the process according to the present invention wherein a melt-kneaded composition is pulverized and classified.

In the process of the present invention, a pulverized product from a first pulverization step and a pulverized feed are together sent to a first classification step, and a coarse powder classified in the first classification step is introduced to the first pulverization step and pulverized therein under the action of an impact (force).

A first classified fine powder classified in the first classification step is further classified in a second classification step, and a second classified coarse powder from the second classification step is pulverized in a second pulverization step under the action of an impact which is smaller than that applied in the first pulverization step. The resultant pulverized product from the second coarse powder is introduced into the first classification step or the second classification step. The second classified fine powder classified in the second classification step is ordinarily introduced into a third classification step (not shown) to principally remove minute powder having a particle size below a prescribed range, thereby providing colored resinous particles for toner powder having a prescribed average particle size and particle size distribution.

The above process may ordinarily be practiced by using an integral apparatus system wherein equipments for practicing the respective steps are connected by connecting means such as pipe means. A prepared embodiment of such an apparatus is illustrated in FIG. 4.

Figure 4:
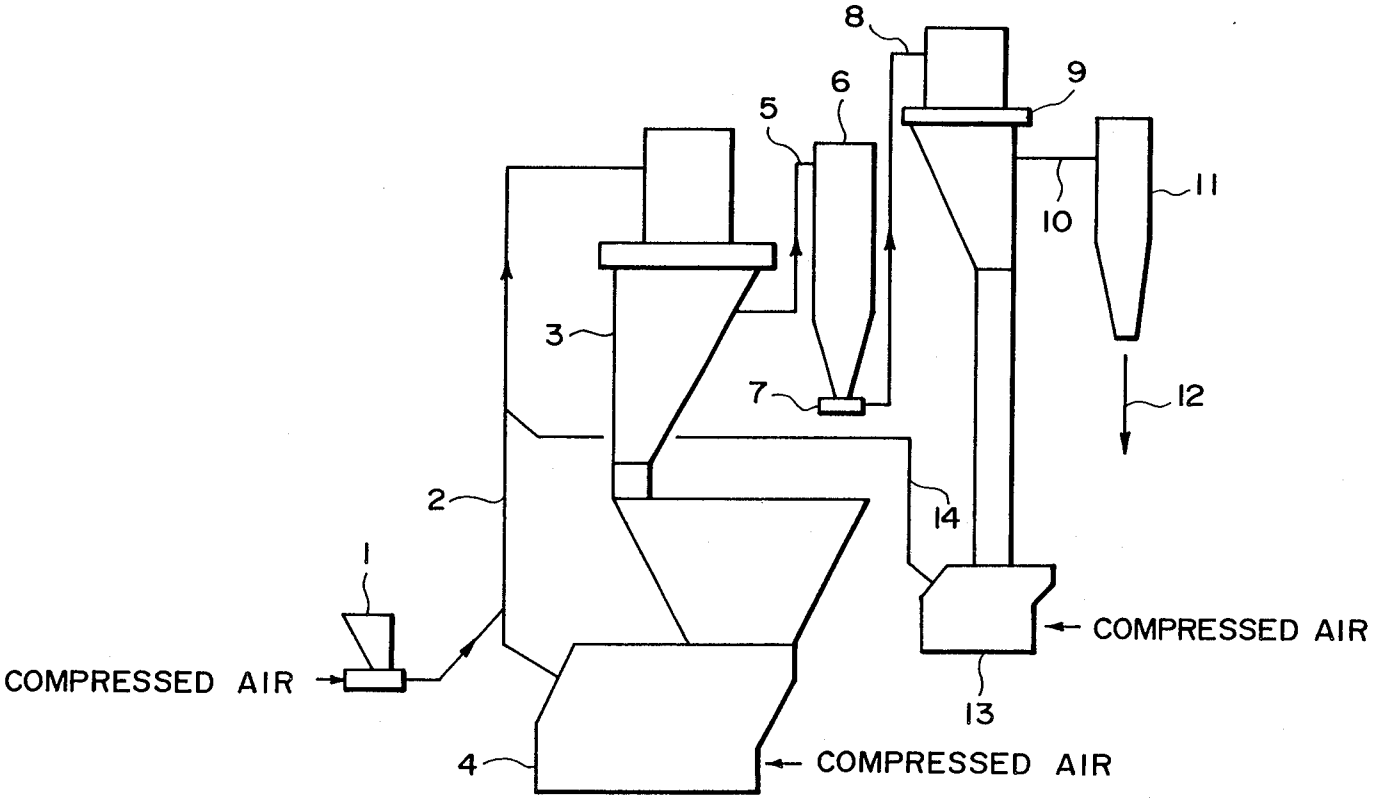
FIG. 4 is a flow chart according to an embodiment of the present invention (Example 2)

The apparatus system shown in FIG. 4 includes a first pulverizer 4, a first classifier 3, a first classifying cyclone 6, an injection feeder for transportation 7, a second classifier 9, a second pulverizer 13, and a second classifying cyclone 11 connected by pipe means 2, 5, 8, 10 and 14.

In the apparatus system, a powder feed is supplied by an injection feeder having a feed hopper 1 through a feed supply pipe 2 to a first classifier 3. A first classified coarse powder classified in the first classifier 3 is introduced into the pulverizer 4 and pulverized therein under the action of an impact, and the pulverized product is introduced into the first classifier 3 through the pipe 2.

On the other hand, the first classified fine powder obtained by the classification is sent through the pipe 5, collected by the collecting cyclone 6, taken out from the cyclone 6 by means of the injection feeder 7, introduced through the pipe 8 into the second classifying means 9 and classified therein. The resultant second classified powder is pulverized in the second pulverizer 13 under the action of a smaller impact than in the first pulverizer 4. The resultant second pulverized product is introduced through the pipe 14 into the first classifier 3 together with the powder feed and the first pulverized product.

The second classified powder is sent through the pipe 10, collected by the collecting cyclone 11 and discharged out of a discharge port 12.

The second classified fine powder discharged from the discharge port 12 is introduced into a third classifier (not shown) whereby ultra-minute powder or minute powder below a prescribed range is removed from the fine powder to prepare colored resinous particles for toner powder having a regulated particle size distribution.

The pulverizers 4 and 13 may be an impact-type pulverizer or jet-type pulverizer. In view of the compactness of a pulverizer and little sticking of powder to the inner wall of a pulverizer, a jet-type pulverizer is preferred. Any pulverizer is required to be capable of effecting pulverization to an objective particle size. A commercially available example of the impact type pulverizer may be MVM pulverizer available from Hosokawa Micron K.K. and examples of the jet-type pulverizer may include PJM-I available from Nihon Pneumatic Kogyo K.K., Micron Jet available from Hosokawa Micron K.K., Jet-O-Mizer available from Seishin Kigyo K.K., Blow-Knox, and Trost Jet Mill.

The classifiers 3 and 9 may be a fixed walltype centrifugal air classifier, such as DS Separator mfd. by Nihon Pneumatic Kogyo K.K., Turbo-Classifier mfd. by Nisshin Engineering K.K., and MS Separator mfd. by Hosokawa Micron K.K.

Figure 3:
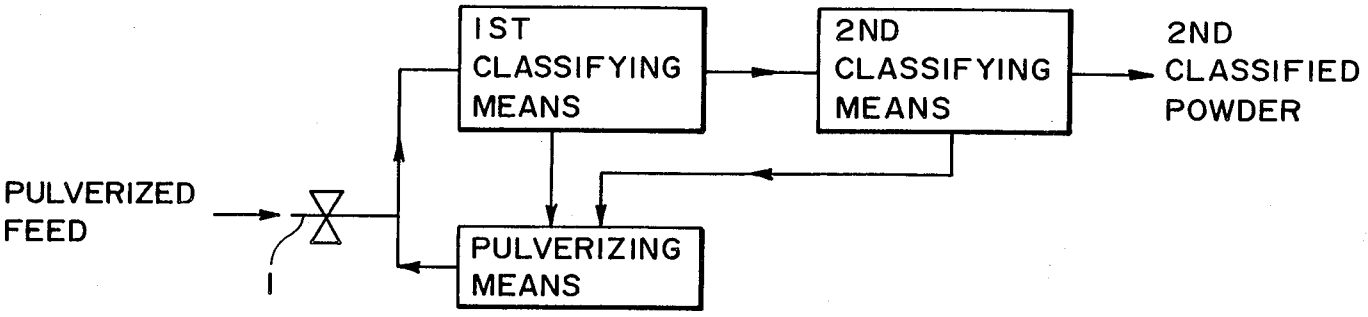
FIG. 3 PRIOR ART

According to the present invention, there is provided an increase in processing capacity by 50–100% compared with a conventional apparatus system by adding a pulverizer occupying a small proportion (on the order of 10%) of the investment. With respect to energy consumption, an electric power for operating the second pulverizing means 13 is increased compared with a conventional example (FIG. 3). However, the power consumption in the classification step is not substantially changed while the production efficiency is remarkably increased. As a result, the power consumption per unit weight of the powder feed can be reduced by a large proportion of 15% to 30%.

As another advantageous effect of the present invention, when the second coarse powder classified in the second classification step is pulverized in the second classifying means, the second coarse powder may have a particle size close to that of the toner and may contain little minute powder, so that overpulverization is prevented and the occurrence of ultra-minute powder of below 2 μm and agglomerates of minute powder are prevented to provide colored resinous particles having a sharp particle size distribution. Further, the yield of a classified product (colored resinous particles) when subjected to the third classification step to remove minute particles having particle sizes below 7–8 μm from the second classified fine powder, is also improved by 3–5%, and the classified product contains less ultra-minute powder or minute powder.

It is important in the present invention that the impact applied for pulverizing the powder in the second pulverization step is smaller than the impact applied in the first pulverization step. In case where the same weight of powder is pulverized successively in a first pulverization step and a second pulverization step, the pulverization area of powder in the second pulverization step is noticeably larger than the pulverization area of powder in the first pulverization step corresponding to the decrease in particle size. For this reason, it is ordinary to apply a large impact in the second pulverization step than in the first pulaverization step. However, in the case of production of colored resinous particles for a toner through melt-kneading, cooling and solidification of a composition comprising a binder resin and a colorant or magnetic material, it has been found advantageous to use a smaller impact for pulverizing the second coarse powder than in the first pulverization step in view of the yield of the colored resinous particles, the developing characteristics thereof, and minimization of energy consumption.

As a specific example, in the case of using jet mills as pulverizing means, it is possible to suppress the formation of minute and ultra-minute powder and obtain a pulverized product having a sharp particle size distribution by raising the air pressure for jet mill pulverization in the first pulverizing means to 5–10 kg/cm$^2$ and by lowering the air pressure for jet mill pulverization in the second pulverizing means to a level of 2–6 kg/cm$^2$. The difference in air pressure for pulverization between the first pulverization step and the second pulverization step may preferably be 0.5–4 kg/cm$^2$.

Colored resinous particles obtained by further treating the pulverized product obtained in such a process as described above in a subsequent classification step have a good fluidity and provide a toner capable of forming images with a high image density and with less ground fog or less scattering around the images than obtained through the conventional processes.

Figure 5:
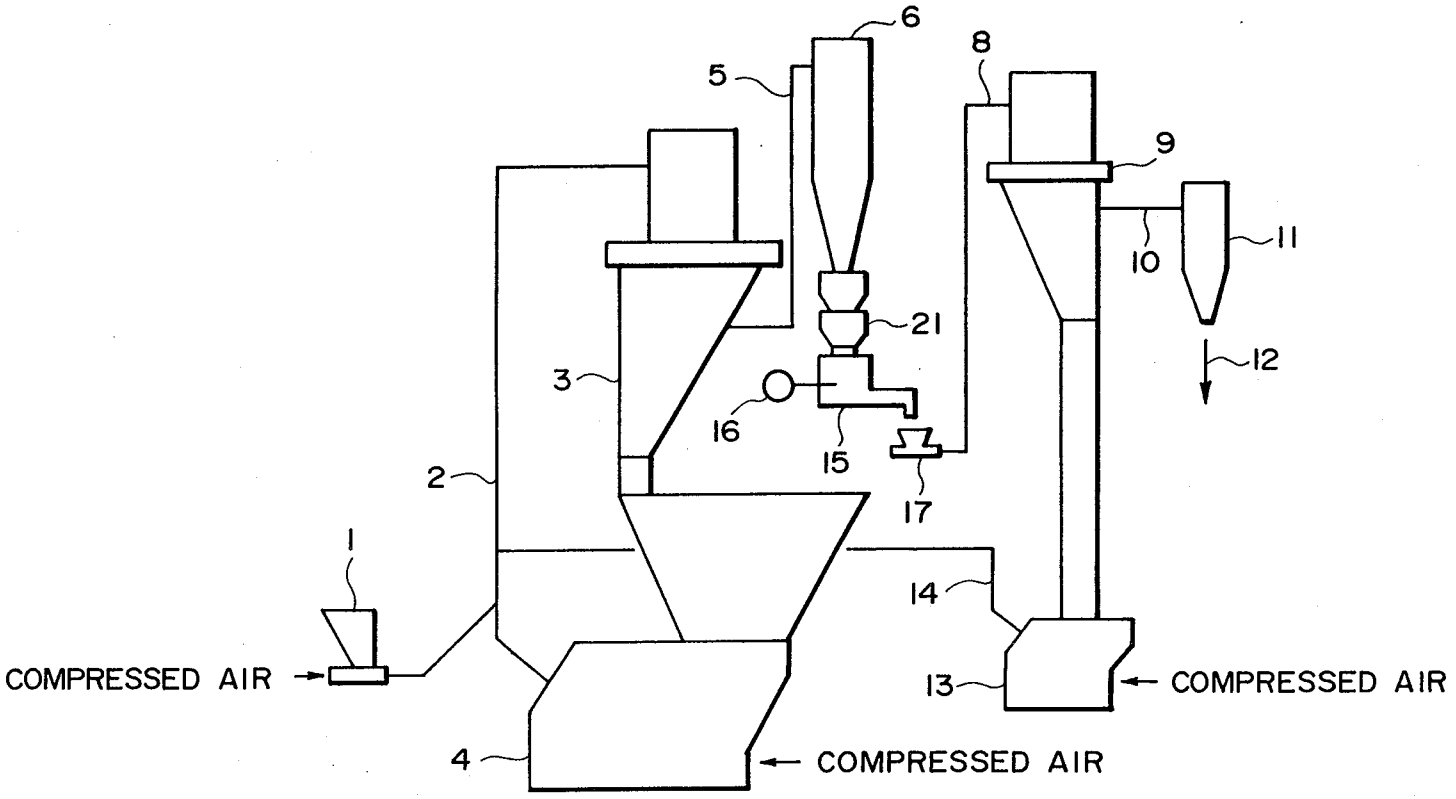
FIG. 5 is a flow chart according to an embodiment of the present invention (Example 1)

For further effective operation of the process according to the present invention, it is preferred to also use a means for preventing pulsation of powder sent to the second classification step. A specific example thereof is shown in FIG. 5, wherein the first classified fine powder at the bottom of the first classifying cyclone 6 is discharged through a discharge double dumper 21, quantitatively supplied by means of a feeder for quantitative feed and received by a chute 17, through which the fine powder is charged to the second classifying means 9 while being dispersed in air.

Figure 6:
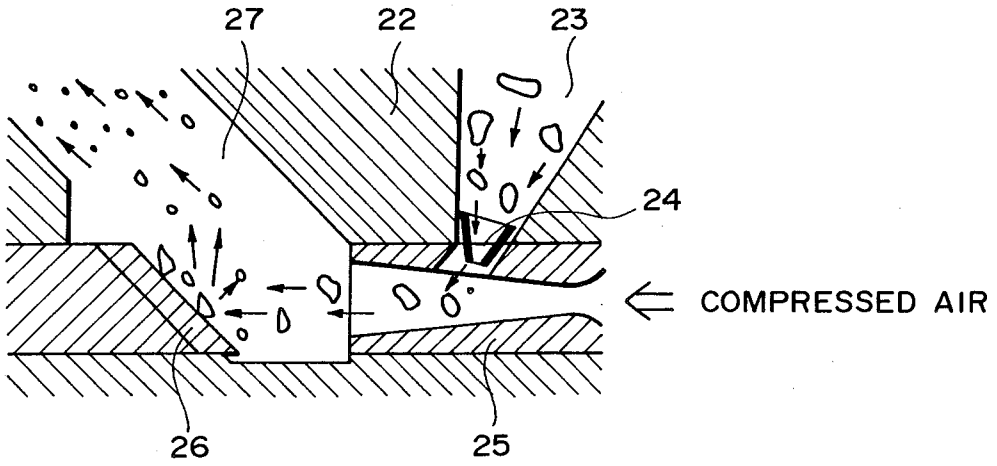
FIG. 6 illustrates an embodiment wherein a pulverizer (jet mill) is provided with a choke means.

The feeder 15 may be operated in such a manner that the feed rate thereof is set to 1.0–1.5 times, preferably 1.1–1.3 times, the rate of the powder supplied through the first classifying cyclone 6 and the feeder 15 is intermittently operated, i.e., stopped when the first classified fine powder is not detected in the feeder 15 by means of a level gauge and operated when detected. Another measure effective for preventing pulsation is to provide a choke means 24 as shown in FIG. 6 to the inlets for the powders supplied to the first and second pulverizing means whereby an excessive flow of the powder is prevented.

Figure 8:
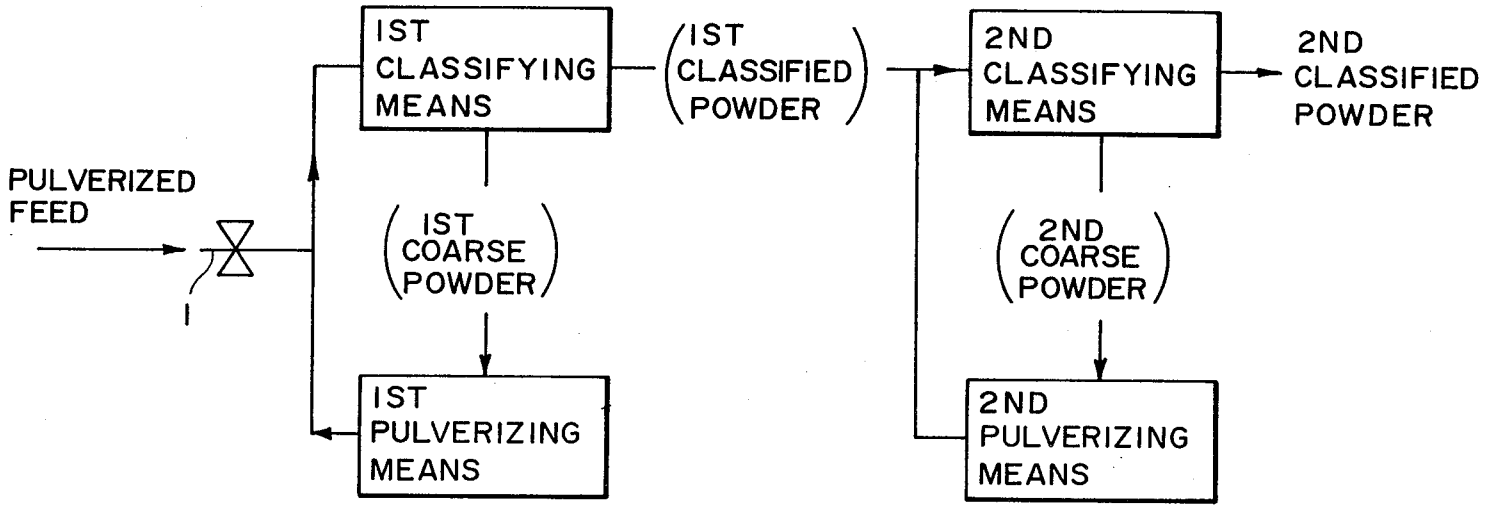
FIG. 8 is a block diagram of another embodiment of the process according to the present invention.
Figure 10:
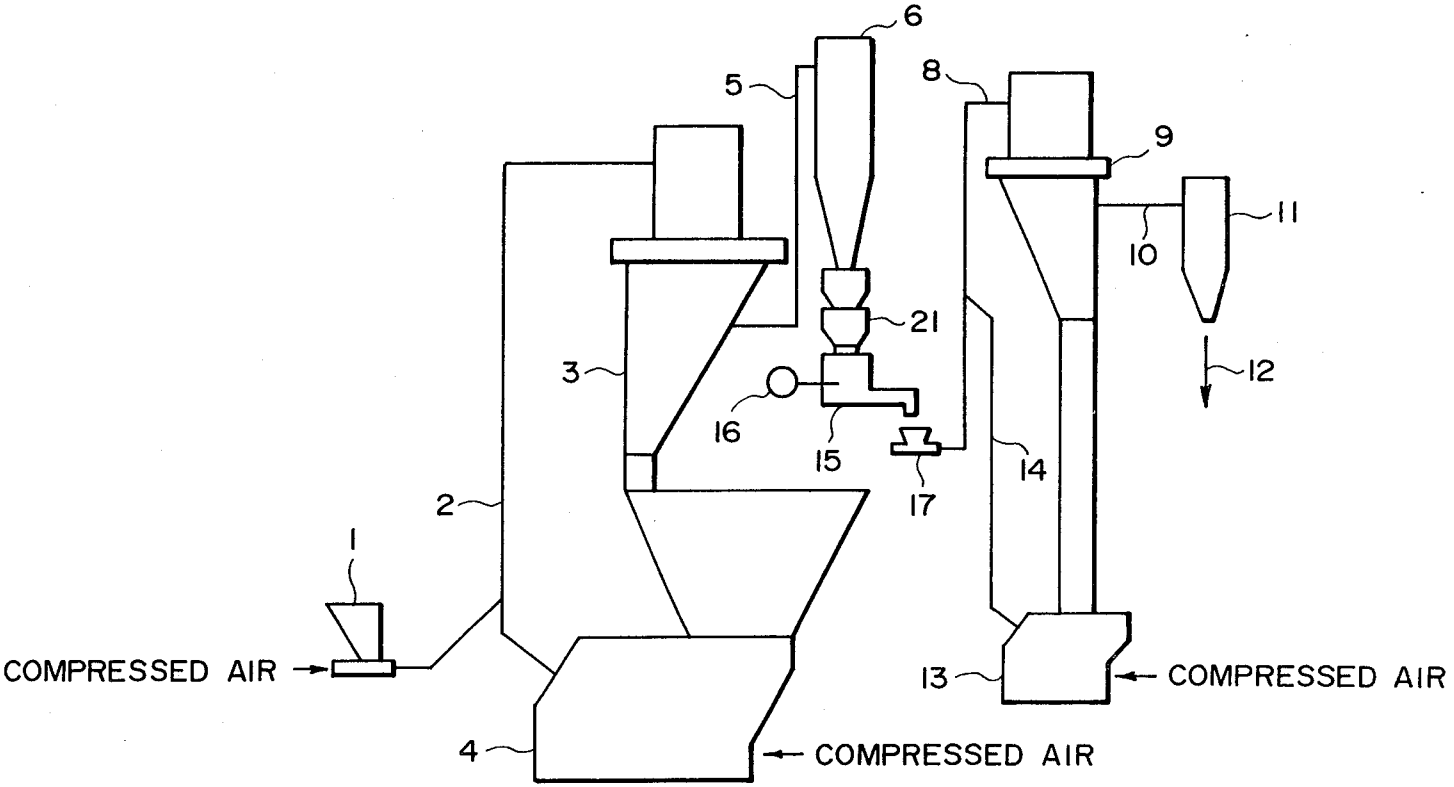
FIG. 10 a flow chart according to still another embodiment of the present invention (Example 3).

In the present invention, it is also possible to introduce the pulverized powder product from the second pulverization step to the second classification step as shown in FIGS. 8–10.

In the present invention, it is preferred that the second classifying means has a processing capacity which is equal to or smaller than that of the first classifying means. More specifically, it is preferred that the second classifying means has a processing capacity which is 1/1 to ⅓, preferably 1/1.5 to 1/2.5, of that of the first classifying means. A classification apparatus of a larger size is not preferable not only because it is disadvantageous from the viewpoint of energy efficiency but also it provides a broader particle size distribution. It is preferred that the air feed rate for classification in the first classification step is set to 10–30 m$^3$/min., the air feed rate for classification in the second classification step is set to 4–20 m$^3$/min., and the air rate in the second classification step is set to be smaller than that in the first classification step by 2–25 m$^3$/min.

The binder resin to the used in the present invention be an ordinary binder resin for toner. Examples thereof may include: homopolymers of styrene and its derivatives, such as polystyrene and polyvinyltoluene; styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-acrylonitrile copolymer, styrene-vinyl ethyl ether copolymer, styrene-vinyl methyl ketone copolymer, styrene-butadiene copolymer, styrene-isopene copolymer, styrene-acrylonitrile-indene copolymer, styrene-maleic acid copolymer, and styrene-maleic acid ester copolymer; polymethyl methacrylate, polybutyl methacrylate, polyvinyl acetate, and polyester. These resins may be used singly or in mixture. Among these, styrene-type resins (inclusive of styrene polymer and styrene copolymer), acrylic resins and polyester-type resins are particularly preferred in view of developing characteristics.

Examples of the colorant used in the present invention may include: carbon black, lamp black, ultramarine, nigrosine dyes, Aniline Blue, Phthalocyanine Blue, Phthalocyanine Green, Hansa Yellow G, Rhodamine 6G Lake, Calcooil Blue, Chrome Yellow, Quinacridone, Benzidine Yellow, Rose Bengal, triarylmethane dyes, monoazo dyes and disazo dyes. These dyes or pigments may be used singly or in mixture.

Ordinarily, 0.1–30 wt. parts of the colorant may be used per 100 wt. parts of the binder resin.

Examples of the magnetic material used in the form of magnetic powder in the present invention may include: iron oxides, such as magnetite, hematite, and ferrite; metals, such as iron, cobalt and nickel, and alloys of these metals with another metal such as aluminum, cobalt, copper, lead, magnesium, tin, zinc, antimony, beryllium, bismuth, cadmium, calcium, manganese, selenium, titanium, tungsten, and vanadium; and mixtures of these materials. These magnetic materials may preferably have an average particle size on the order of 0.1–2 μm. The magnetic material may preferably be contained in a proportion of about 20 to 200 wt. parts, particularly about 40 to 150 wt. parts, per 100 wt. parts of the binder resin.

The pulverized feed material may be prepared by preliminarily mixing a composition comprising at least a binder resin and a colorant or magnetic material, melt-kneading the pre-mixed composition by a hot kneading means such as heated rollers, a kneader or an extruder at a temperature of ordinarily 100° to 250° C., cooling the kneaded product to produce a solidified product, and coarsely pulverizing a crushing the solidified product by means of a mechanical pulverizer such as a hammer mill.

The coarsely pulverized feed may preferably have an average particle size of 20–2000 μm.

If it is assumed that the colored resinous particles are desired to have a volume-average particle size of a μm, it is preferred that the first classified fine powder has a volume-average particle size which is larger by 1–25 μm, particularly 1–15 μm, than a μm. Further, it is preferred that the first classified coarse powder has a volume-average particle size larger by 5–50 μm, particularly 5–20 μm, than a μm and the second classified coarse powder has a volume-average particle size larger by 3–30 μm, particularly 3–15 μm, than a μm in order to increase the production efficiency and suppress the formation of minute powder.

Hereinbelow, the present invention will be explained based on specific examples.

EXAMPLE 1 AND COMPARATIVE EXAMPLE 1

Colored resinous particles were produced by using a system shown in FIG. 5.

| | |
|---|---|
| Styrene-acrylic acid ester copolymer | 100 wt. parts |
| Magnetic material (average particle size: 0.3 μm) | 60 wt. parts |
| Positive charge control agent | 2 wt. parts |
| Low-molecular weight polyethylene | 4 wt. parts |

A pulverized feed was prepared by melt-kneading the above composition, cooling and solidifying the kneaded product and pulverizing the solidified product to an average particle size of about 1000 μm by means of a hammer mill provided with a 3 mm-screen. As the first pulverizer 4, a jet mill (Model I-10 mfd. by Nihon Pneumatic Kogyo K.K., power consumption: about 72 KW/hour) was used with the air pressure for pulverization being set to 6 kg/cm$^2$. On the other hand, as the second pulverizer 13, a jet mill (Model I-5, mfd. by Nihon Pneumatic Kogyo K.K., power consumption about 27 KW/hour) which was smaller in capacity than the first pulverizer was used with the air pressure for pulverization being set to 4.5 kg/cm$^2$. As the first classifier 3, a wind-force classifier (Model DS-10, mfd. by Nihon Pneumatic Kogyo K.K., power consumption about 20 KW/hour) was used and operated at a classifying air rate of 20 m$^3$/min so as to provide the first classified coarse powder and the first classified fine powder with particle sizes of 30–50 μm and 15–30 μm, respectively, in terms of a volume-average particle size as measured by Coulter counter. As the second classifier 9, a wind-force classifier (Model DS-5, power consumption: about 10 KW/hour) which was smaller in capacity than the classifier 3 was used and operated at a classifying air rate of 10 m$^3$/min so as to provide the second classified coarse powder and the second classified fine powder with particle sizes of 20–35 μm and 10–12 μm, respectively, in terms of a volume-average particle size as measured by Coulter counter.

Figure 7:
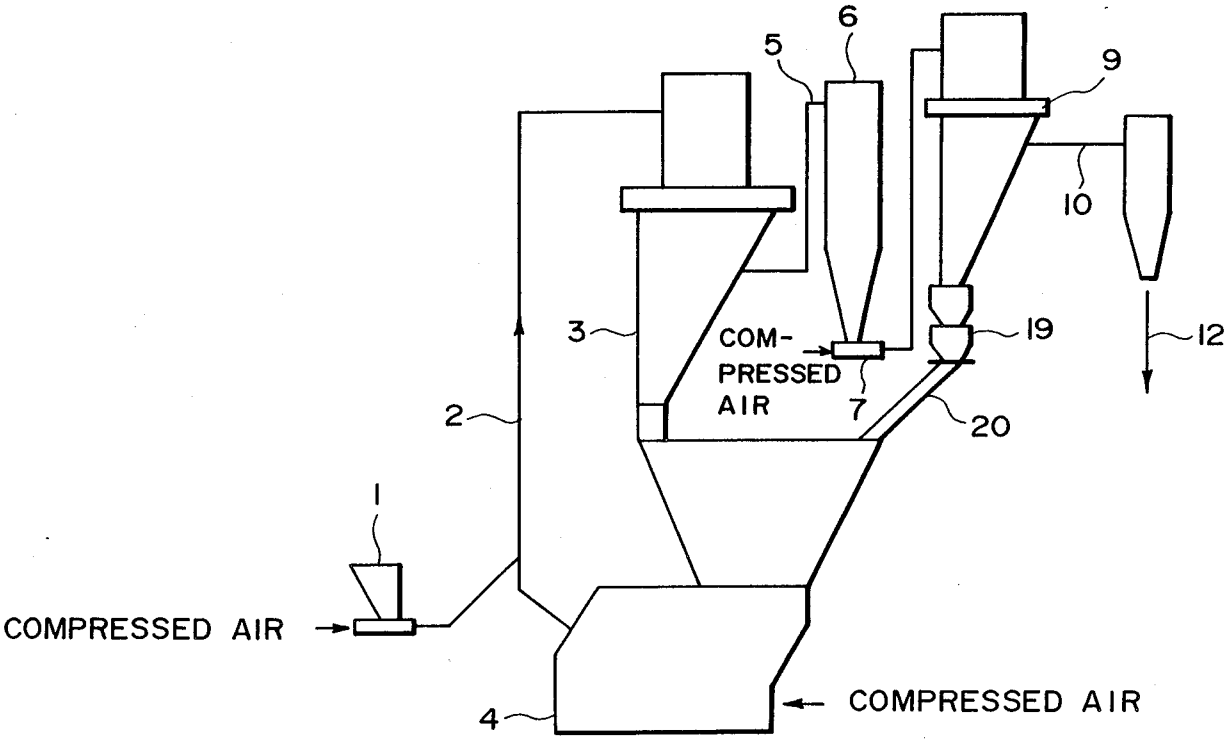
FIG. 7 a flow chart of a comparative example.

On the other hand, as Comparative Example 1, an apparatus system shown in FIG. 7 was set up by using the same models of the first pulverizer 4, the first classifier 3 and the second classifier 9 as used in the above-mentioned Example 1, and the pulverized feed used in Example 1 was pulverized and classified in the system.

The results of Example 1 and Comparative Example 1 are inclusively shown in the following Table 1.

TABLE 1

| | Example 1 (I-10/DS10 /I-5/DS5) | Comparative Example 1 (I-10/DS-10 /DS-5) |
|---|---|---|
| (1) Processing capacity | 1.36 | 1 |
| (2) Energy comsumption | 0.80 (20% reduction) | 1 |
| (3) Investment efficiency | 0.86 (14% reduction) | 1 |
| (4) Particle size distribution** (of pulverized product from discharge port 12) | | |
| Volume-average particle size | 11.1 μm | 11.2 μm |
| below 6.35 μm (volume) | 15.6% | 17.4% |
| below 2.00 μm (volume) | 0.1% | 0.3% |
| above 20.2 μm (volume) | 0.6% | 3.4% |
| 6.35 μm–20.2 μm | 83.8% | 79.2% |

**Based on measurement by Coulter counter

Then, the pulverized products of Example 1 and Comparative Example 1 obtained through the respective discharge ports 12 were respectively introduced to a third classifier (Model DS-5, mfd. by Nihon Pneumatic Kogyo K.K.) in order to remove minute powder (consisting principally of particles with sizes below about 6 μm), thereby to obtain two type of colored resinous particles. Each type of colored resinous particles (toner powder) in an amount of 100 wt. parts was mixed with 0.4 wt. part of positively chargeable hydrophobic silica to prepare a one component developer, which was then subjected to a copying test by means of a copying machine (NP-150Z, mfd. by Canon K.K.).

The results are shown in the following Table 2.

TABLE 2

| | Example 1 | Comparative Example 1 |
|---|---|---|
| Volume-average particle size of colored resinous particles after removal of minute powder (μm) | 11.4 | 11.5 |

TABLE 2-continued

| | Example 1 | Comparative Example 1 |
|---|---|---|
| Particle size distribution of colored resinous particles after removal of minute powder | | |
| Below 6.35 μm (vol. %) | 2.4 | 2.6 |
| Below 2.00 μm (vol. %) | 0 | 0 |
| Above 20.2 μm (vol. %) | 0.9 | 4.6 |
| 6.35–20.2 μm (vol. %) | 96.7 | 92.8 |
| Yield of colored resinous particles (%) | 78 | 72 |
| Degree of agglomeration of colored resinous particles (%) | about 60 | about 75 |
| Developing characteristics of a developer comprising the colored resinous particles | | |
| (1) Image density | 1.15 | 1.12 |
| (2) Fog | o | Δ |
| (3) Scattering around images | o | Δ |

As apparent from the data shown in Tables 1 and 2 above, Example 1 according to the present invention gave better results in respect of processing capacity and energy consumption and also in respect of yield of the colored resinous particles.

The methods and standards of evaluation for respective items in the above tables and the table appearing hereinafter are as follows.

(a) Processing capacity

Calculated by using the following equation.

Processing capacity in each Example of the present invention=(Amount of coarsely pulverized feed processed per hour by each Example (Kg))/(Amount of coarsely pulverized feed processed per hour by the corresponding Comparative Example (Kg)).

The processing capacity of each Comparative Example is indicated as 1 (unit) as a basis for relative indication. A larger value represents a better processing capacity.

(b) Energy consumption for each Example=(Power consumed per hour (KW/hr) divided by the amount of processed pulverized feed per hour (Kg/hr) in each Example of the present invention)/(Power consumed per hour (KW/hr) divided by the amount of processed pulverized feed per hour (Kg/hr) in the corresponding Comparative Example).

The energy consumption of each Comparative Example is indicated as 1 (unit) as a basis for relative indication. A smaller value represents a better energy or process efficiency.

(c) Investment efficiency for each Example=(Invested money (V) as equipment cost divided by the amount of processed pulverized feed per hour (Kg/hr) in each Example of the present invention)/(Invested money (V) as equipment cost divided by the amount of processed pulverized feed per hour (Kg/hr) in the corresponding Comparative Example).

The investment efficiency of each Comparative Example is indicated as 1 (unit). A lower value represents a better investment efficiency.

(d) Particle size distribution

A Coulter counter Model TA-II was used for measurement of particle size including a particle size region of below 2 μm.

(e) Yield of colored resinous particles=(Rate of production of colored resinous particles (Kg/hr))×100/(Rate of pulverized feed supplied to the system (Kg/hr)).

(f) Degree of agglomeration

The degree of agglomeration was measured in a method wherein a sample powder was placed on a sieve system and the proportion of the sample powder remaining on the sieve system after vibration was measured.

According to this method, a larger parcentage of powder remaining on a sieve system represents a larger degree of agglomeration and a larger liability of the powder behaving as a mass. The method is more specifically explained as follows:

A powder tester available from Hosokawa Micron K.K. is used for measurement under the conditions of a temperature of 25±1° C. (and a humidity of 60±5%).

Sieves of 60 mesh, 100 mesh and 200 mesh are overlaid in this order from the above, and the sieve system is set on a vibrating stage. A sample toner in an amount of 2 g of placed on the 60 mesh sieve, and a voltage of 47 volts is applied to the vibrating system for 40 seconds of vibration.

After the vibration, the weights of the powder remaining on the respective sieves are multiplied by weight factors of 0.5, 0.3 and 0.1, respectively, and added to provide a total. The degree of agglomeration is calculated as a percentage value.

(g) Image density and image evaluation

The image density indicated in an average of 5 measured values for one sample copy measured with solid image portions by means of a McBeth densitometer. The symbols for image evaluation represent the following: o . . . Good, oΔ . . . Rather good, Δ . . . Ordinary.

Example 2 and Comparative Example 2

Colored resinous particles were produced by using a system shown in FIG. 4.

A pulverized feed was prepared by melt-kneading the same composition as used in Example 1, cooling and solidifying the kneaded product and pulverizing the solidified product to an average particle size of about 1000 μm by means of a hammer mill provided with a 3 mm-screen. As the pulverizer 4, a jet mill (Model I-10 mfd by Nihon Pneumatic Kogyo K.K., power consumption: about 72 KW/hour) was used with the air pressure for pulverization being set to 6 kg/cm$^2$. As the pulverizer 13, a jet mill (Model I-5, mfd. by Nihon Pneumatic Kogyo K.K., power consumption: about 30 KW/hour) which was smaller in capacity than the first pulverizer was used with the air pressure for pulverization being set to 5 kg/cm$^2$. As the classifier 3, a wind-force classifier (Model MS-3, mfd. by Nihon Pneumatic Kogyo K.K., power consumption: about 40 KW/hour) was used and operated at a classifying air rate of 25 m$^3$/min so as to provide the first classified coarse powder and the first classified fine powder with particle sizes of 30–50 μm and 15–30 μm, respectively, in terms of a volume-average particle size as measured by Coulter counter. As the classifier 9, a wind-force classifier (Model MSS-1, power consukption: about 16 KW/hour) which was smaller in capacity than the classifier 3 was used and operated at a classifying air rate of 15 $m^3$/min so as to provide the second classified coarse powder and the second classified fine powder with particle sizes of 20–35 μm and 10–12 μm, respectively, in terms of a volume-average particle size as measured by Coulter counter.

On the other hand, as Comparative Example 2, an apparatus system shown in FIG. 7 was set up by using the same models of the first pulverizer 4, the first classifier 3 and the second classifier 9 as used in the above-mentioned Example 2, and the pulverized feed used in Example 2 was pulverized and classified in the system.

The results of Example 2 and Comparative Example 2 are inclusively shown in the following Table 3.

TABLE 3

| | Example 2 (I-10/MS-3 /I-5/MSS-1) | Comparative Example 2 (I-10/MS-3 /MSS-1) |
|---|---|---|
| (1) Processing capacity | 1.50 | 1 |
| (2) Energy comsumption | 1.81 (19% reduction) | 1 |
| (3) Investment efficiency | 0.73 (27% reduction) | 1 |
| (4) Particle size distribution** (of pulverized product from discharge port 12) | | |
| Volume-average particle size | 11.2 μm | 11.3 μm |
| below 6.35 μm (volume) | 16.8% | 18.8% |
| below 2.00 μm (volume) | 0.2% | 0.5% |
| above 20.2 μm (volume) | 1.1% | 2.7% |
| 6.35 μm–20.2 μm | 92.1% | 88.5% |

**Based on measurement by Coulter counter

Then, the pulverized products of Example 2 and Comparative Example 2 obtained from the respective discharge ports 12 were respectively introduced to a third classifier (Model DS-5, mfd. by Nihon Pneumatic Kogyo K.K.) in order to remove minute powder, thereby to obtain two types of colored resinous particles. A developer was prepared from each type of colored resinous particles and then subjected to a copying test in the same manner as in Example 1.

The results are shown in the following Table 4.

TABLE 4

| | Example 2 | Comparative Example 2 |
|---|---|---|
| Volume-average particle size of colored resinous particles after removal of minute powder (μm) | 11.5 | 11.5 |
| Particle size distribution of colored resinous particles after removal of minute powder | | |
| Below 6.35 μm (vol. %) | 2.7 | 2.8 |
| Below 2.00 μm (vol. %) | 0 | 0 |
| Above 20.2 μm (vol. %) | 1.3 | 4.2 |
| 6.35–20.2 μm (vol. %) | 96.0 | 93.0 |
| Yield of colored resinous particles (%) | 74.0 | 72.0 |
| Degree of agglomeration of colored resinous particles (%) | about 67 | about 75 |
| Developing characteristics of a developer comprising the colored resinous particles | | |
| (1) Image density | 1.11 | 1.07 |
| (2) Fog | oΔ | oΔ |
| (3) Scattering around images | o | |

As apparent from the data shown in Tables 3 and 4 above, Example 2 according to the present invention gave better results in respect of processing capacity and energy consumption and also in respect of yield of the colored resinous particles.

Example 3 and Comparative Example 3

Colored resinous particles were produced by using a system shown in FIG. 10.

A pulverized feed was prepared by melt-kneading the same composition as used in Example 1, cooling and solidifying the kneaded product and pulverizing the solidified product to an average particle size of about 1000 μm by means of a hammer mill provided with a 3 mm-screen. As the pulverizer 4, a jet mill (Model I-10 mfd. by Nihon Pneumatic Kogyo K.K., power consumption: about 72 KW/hour) was used with the air pressure for pulverization being set to 6 kg/$cm^2$. As the second pulverizer 13, a jet mill (Model I-5, mfd. by Nihon Pneumatic Kogyo K.K., power consumption: about 27 KW/hour) was used with the air pressure for pulverization being set to 4.5 kg/$cm^2$. As the classifier 3, a wind-force classifier (Model DS-10, mfd. by Nihon Pneumatic Kogyo K.K., power consumption: about 20 KW/hour) was used and operated at a classifying air rate of 20 $m^3$/min so as to provide the first classified coarse powder and the first classified fine powder with particle sizes of 30–50 μm and 12–18 μm, respectively, in terms of a volume-average particle size as measured by Coulter counter. As the classifier 9, a wind-force classifier (Model DS-5, power consumption: about 10 KW/hour) which was smaller in capacity than the classifier 3 was used and operated at a classifying air rate of 10 $m^3$/min so as to provide the second classified coarse powder and the second classified fine powder with particle sizes of 18–23 μm and 10–12 μm, respectively, in terms of a volume-average particle size as measured by Coulter counter.

On the other hand, as Comparative Example 3, an apparatus system shown in FIG. 7 was set up by using the same models of the first pulverizer 4, the first classifier 3 and the second classifier 9 as used in the above-mentioned Example 3, and the pulverized feed used in Example 3 was pulverized and classified in the system.

The results of Example 3 and Comparative Example 3 are inclusively shown in the following Table 5.

TABLE 5

| | Example 3 (I-10/DS10 /I-5/DS5) | Comparative Example 3 (I-10/DS-10 /DS-5) |
|---|---|---|
| (1) Processing capacity | 1.23 | 1 |
| (2) Energy comsumption | 0.90 (10% reduction) | 1 |
| (3) Investment efficiency | 0.89 (11% reduction) | 1 |
| (4) Particle size distribution** (of pulverized product from discharge port 12) | | |
| Volume-average particle size | 11.1 μm | 11.2 μm |
| below 6.35 μm (volume) | 16.5% | 17.4% |
| below 2.00 μm (volume) | 0.2% | 0.3% |
| above 20.2 μm (volume) | 1.1% | 3.4% |
| 6.35 μm–20.2 μm | 82.4% | 79.2% |

**Based on measurement by Coulter counter

Then, the pulverized products of Example 3 and Comparative Example 3 obtained from the respective discharge ports 12 were respectively introduced to a third classifier (Model DS-5, mfd. by Nihon Pneumatic Kogyo K.K.) in order to remove minute powder, thereby to obtain two types of colored resinous particles. A developer was prepared from each type of colored resinous particles and then subjected to a copying test in the same manner as in Example 1.

The results are shown in the following Table 6.

TABLE 6

| | Example 3 | Comparative Example 3 |
|---|---|---|
| Volume-average particle size of colored resinous particles after removal of minute powder (μm) | 11.5 | 11.6 |
| Particle size distribution of colored resinous particles after removal of minute powder | | |
| Below 6.35 μm (vol. %) | 2.6 | 2.8 |
| Below 2.00 μm (vol. %) | 0 | 0 |
| Above 20.2 μm (vol. %) | 1.4 | 4.5 |
| 6.35–20.2 μm (vol. %) | 96.0 | 92.7 |
| Yield of colored resinous particles (%) | 75 | 72 |
| Degree of agglomeration of colored resinous particles (%) | about 67 | about 75 |
| Developing characteristics of a developer comprising the colored resinous particles | | |
| (1) Image density | 1.15 | 1.07 |
| (2) Fog | oΔ | Δ |
| (3) Scattering around images | oΔ | Δ |

As apparent from the data shown in Tables 5 and 6 above, Example 3 according to the present invention gave better results in respects of processing capacity and energy consumption and also in respect of yield of the colored resinous particles.

What is claimed is:

1. A process for producing colored resinous particles for use in toner powder, comprising:

preparing a pulverized feed material by melt-kneading a composition comprising at least a binder resin and a colorant or magnetic material, cooling and solidifying the kneaded product, and pulverizing the solidified product;

introducing the pulverized feed material into a first classification step to classify the feed material into a first coarse powder and a first classified fine powder;

introducing the classified first coarse powder into a first pulverization step to pulverize the coarse powder under the action of an impact force;

introducing the resultant pulverized product of the first coarse powder into the first classification step together with the pulverized feed material;

introducing the first classified fine powder into a second classification step to classify the fine powder into a second coarse powder and a second classified fine powder;

introducing the classified second coarse powder into a second pulverization step to pulverize the coarse powder under the action of an impact force which is smaller than that exerted in the first pulverization step;

introducing the resultant pulverized product of the second coarse powder into the first classification step or the second classification step; and removing a minute powder fraction from the second classified fine powder for adjusting a particle size distribution, thereby to obtain the colored resinous particles.

2. A process according to claim 1, wherein the first pulverization step and the second pulverization step are respectively effected by means of a jet mill.

3. A process according to claim 2, wherein the first coarse powder is pulverized under the action of an air pressure for jet milling of 5–10 kg/cm$^2$ in the first pulverization step and the second coarse powder is pulverized under the action of an air pressure for jet milling of 2–6 Kg/cm$^2$ in the second pulverization step which is lower than the air pressure exerted in the first pulverization step.

4. A process according to claim 3, wherein the air pressure in the second pulverization step is lower than the air pressure in the first pulverization step by 0.5–4 $Kg/cm^2$.

5. A process according to claim 1, wherein the first classification step and the second classification step are respectively effected by a fixed wall-type wind-force classifier.

6. A process according to claim 5, wherein the wind force classifier used in the second classification step has a processing capacity which is 1/1 to ⅓ of that of the wind-force classifier used in the first classification step.

7. A process according to claim 5, wherein the wind-force classifier in the first classification step is operated at a classifying air rate of 10 to 30 $m^3/min$, and the wind-force classifier in the second classification step is operated at a classifying air rate of 4–20 $m^3/min$ which is lower than that in the first classification step.

8. A process according to claim 7, wherein the classifying air rate in the second classification step is lower than that in the first classification step by 2–25 $m^3/min$.

9. A process according to claim 1, wherein the solidified product contains 20–200 wt. parts of the magnetic material per 100 wt. parts of the binder resin.

10. A process according to claim 1, wherein the solidified product contains 0.1–30 wt. parts of the colorant per 100 wt. parts of the binder resin.

11. A process according to claim 1, wherein the pulverized feed material has an average particle size of 20–2000 μm.

12. A process according to claim 1, wherein the colored resinous particles have a volume-average particle size which is smaller by 1–25 μm than that of the first classified fine powder, smaller by 5–50 μm than that of the classified first coarse powder and smaller by 3–30 μm than that of the classified second coarse powder.

* * * * *